US005232219A

United States Patent [19]

Tseng

[11] Patent Number: 5,232,219

[45] Date of Patent: Aug. 3, 1993

[54] BUMPER FOR RACKET FRAME

[76] Inventor: Kuni Tseng, 6F-1, No. 342, Keelung Road, Sec. 1, Taipei, Taiwan

[21] Appl. No.: 960,949

[22] Filed: Oct. 14, 1992

[51] Int. Cl.[5] ..... A63B 49/14

[52] U.S. Cl. ..... 273/73 D; 273/73 R

[58] Field of Search ..... 273/73 R, 73 C, 73 D

[56] References Cited

U.S. PATENT DOCUMENTS

| | | | |
|---|---|---|---|
| 4,802,678 | 2/1989 | Svoma | 273/73 C X |
| 5,009,422 | 4/1991 | Soong | 273/73 R X |
| 5,037,097 | 8/1991 | Svoma et al. | 273/73 C |
| 5,092,593 | 3/1992 | Williams et al. | 273/73 R |
| 5,098,099 | 3/1992 | Liu | 273/73 R |
| 5,102,132 | 4/1992 | Chen | 273/73 R |
| 5,137,274 | 8/1992 | Soong | 273/73 D X |

*Primary Examiner*—V. Millin

*Assistant Examiner*—Raleigh W. Chiu

*Attorney, Agent, or Firm*—Pro-Techtor International

[57] ABSTRACT

A bumper for the racket frame consists of two identical half members, in which each half member comprises a flat strip having inner and outer surfaces in parallel, with one lateral side in substantial straight-cross-section while another lateral side in corrugated cross-section having alternative peak and valley portions, and a plurality of tubes integrally formed an distributed on the inner surface of the flat strip at respective peak portion and extended at an angle with respect to the inner surface of the flat strip along a direction either toward or opposite to the rising of the peak portion to a certain extent. When two half members are respectively installed onto the racket frame to complete an unitary bumper structure, the tubes are so arranged that obliquely extended in opposite directions alterately.

3 Claims, 5 Drawing Sheets

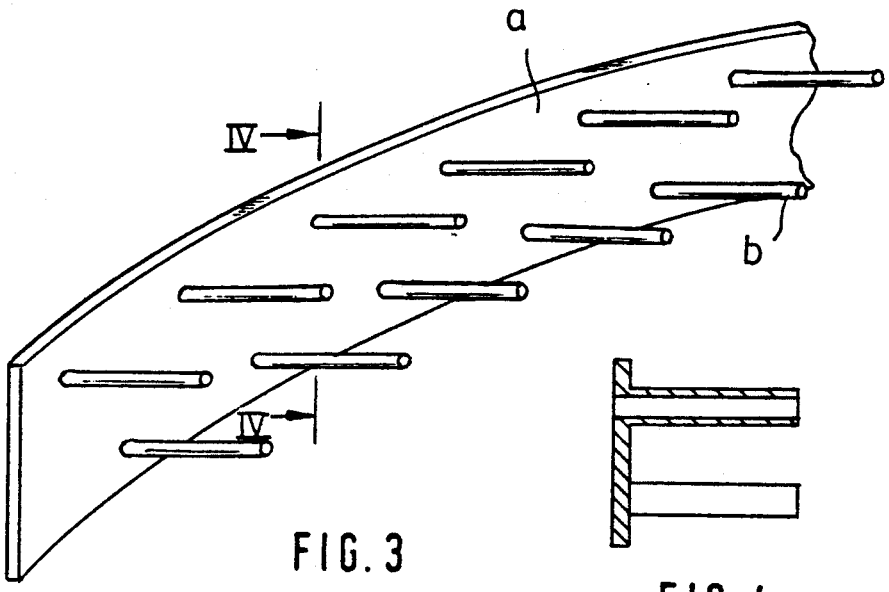
FIG. 3
(prior art)
FIG. 4
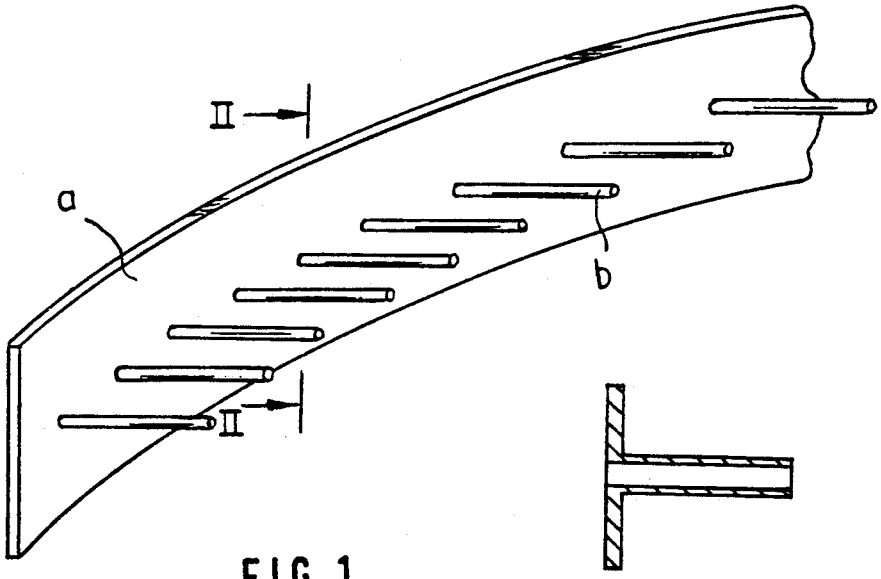
FIG. 1
(prior art)
FIG. 2

BUMPER FOR RACKET FRAME

FIELD OF THE INVENTION

This invention relates to a novel structure of the bumper used for the racket frame.

BACKGROUND OF THE INVENTION

Conventionally, the bumper for the racket frame, for example, such as the embodiments illustrated in FIGS. 1 to 4, comprises a flat strip a and a plurality of tubes b in one or two rows, extending perpendicularly from the inner surface of said strip a. When the bumper is attached onto the outside of the racket frame, said tubes are inserted through the stringing holes preformed in said frame from the outside to the inside thereof, in order to guide the strings of the racket readily passing through the frame.

In U.S. patent application Ser. No. 07/918,466 filed Jul. 22, 1992 by this inventor, a racket with an improved vibration absorbing construction is disclosed and characterized int hat a ridge portion is raised along inner periphery around the had, both lateral sides and the yoke of the frame at the substantial center line, and a soft cushion material is disposed over said ridge portion in direct contact with the strings passing through the frame to accomplish the vibration absorbing effect of the strings all over the strike surface within said frame. In cooperation with this construction, the strings should be obliquely passed through the frame from the outside center thereof along opposite directions alternately to opposite sides of said ridge portion, this is quite different from the conventional manner of the stringing substantially perpendicular to the cross-section of the frame. So that the conventional bumper with perpendicular tubes cannot applies herein. On the contrary, a bumper having oblique tubes along opposite directions alternately is impossibly manufactured by injection moulding process.

SUMMARY OF THE INVENTION

The objects of this invention is to provide a novel structure of the bumper for the racket frame, suitably used in the case that the strings of the frame are obliquely extended form the outside of said frame to the inside of the same and capable of mass production by injection moulding process.

The aforementioned object is accomplished according to the present invention by providing a bumper for the racket frame consisting of two identical half members, in which each half member comprises a flat strip having inner and outer surface in parallel with one lateral side being substantially flat while another lateral side having a corrugated cross-section with alternating peak and valley portions, and a plurality of tubes integrally formed and distributed on said inner surface of said flat strip at respective said peak portion and extended at an angle with respect to said inner surface of said flat strip along a direction either toward or opposite to the rising of said peak portion to a certain extent.

With the bumper for the racket frame according to the present invention, when two half members are respectively installed onto the racket frame to assemble completely as an unitary bumper structure, the tubes are so arranged that obliquely extended in oppositive directions alternately.

The aforementioned and other objects, features and advantages will be better understood from the following description in detail with respect to the embodiments as illustrated in the accompanying drawings.

BRIEF DESCRIPTION OF THE DRAWINGS

FIG. 1 is a fragmentary perspective view, depicting one embodiment of the bumper in prior art;

FIG. 2 is a sectional view taken along the liner II—II of FIG. 1;

FIG. 3 is a fragmentary perspective view depicting another embodiment of the bumper in prior art;

FIG. 4 is a sectional view taken along the lines IV—IV of FIG. 3;

DETAILED DESCRIPTION OF THE PREFERRED EMBODIMENTS

Figure 5:
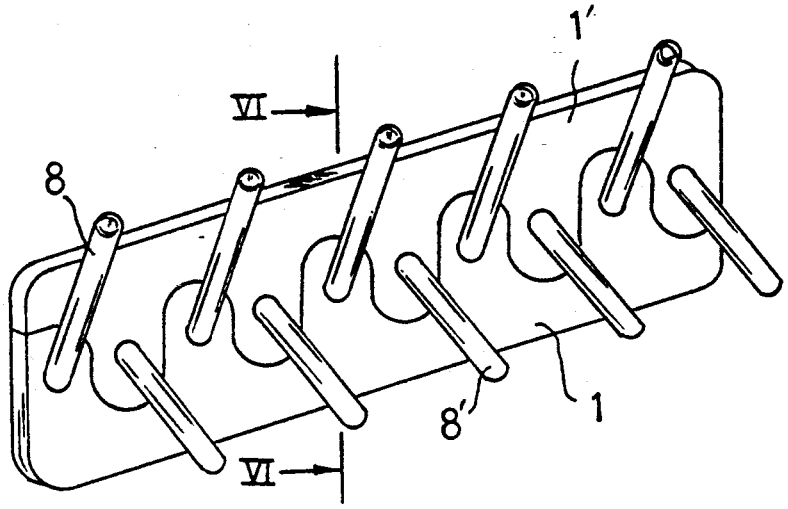
FIG. 5 is a perspective view depicting one embodiment of the bumper in combination according to the present invention.

As referred to FIG. 5 of the drawings, the bumper for the racket frame according to the present invention consists of two identical half members 1,1' made of a resin selected from a group consisting of polyvinyl chloride, polyamides and the like by conventional injection moulding process. The whole bumper is composed of said two half members 1,1' in symmetrically confronting to each other.

Figure 6:
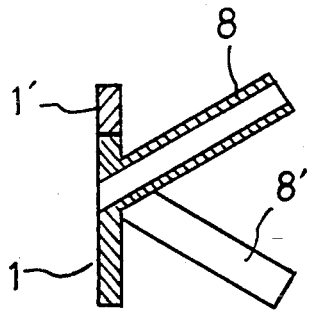
FIG. 6 is a sectional view taken along the lines VI—VI of FIG. 5.
Figure 7:
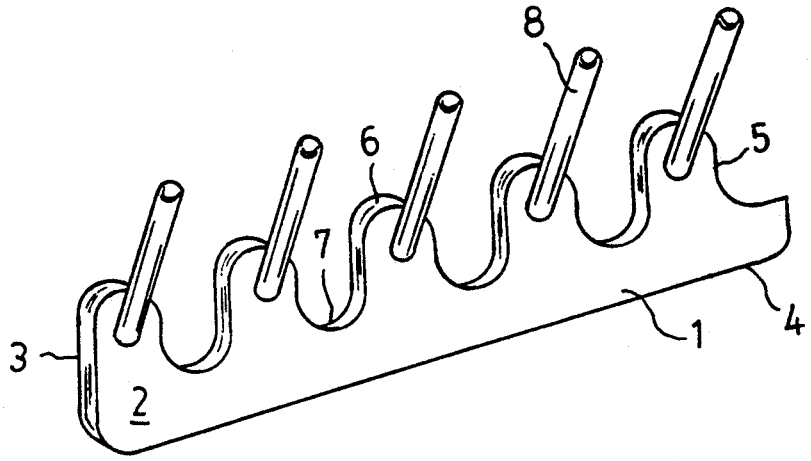
FIG. 7 is a perspective view depicting one half member of the bumper as shown in FIG. 5.
Figure 8:
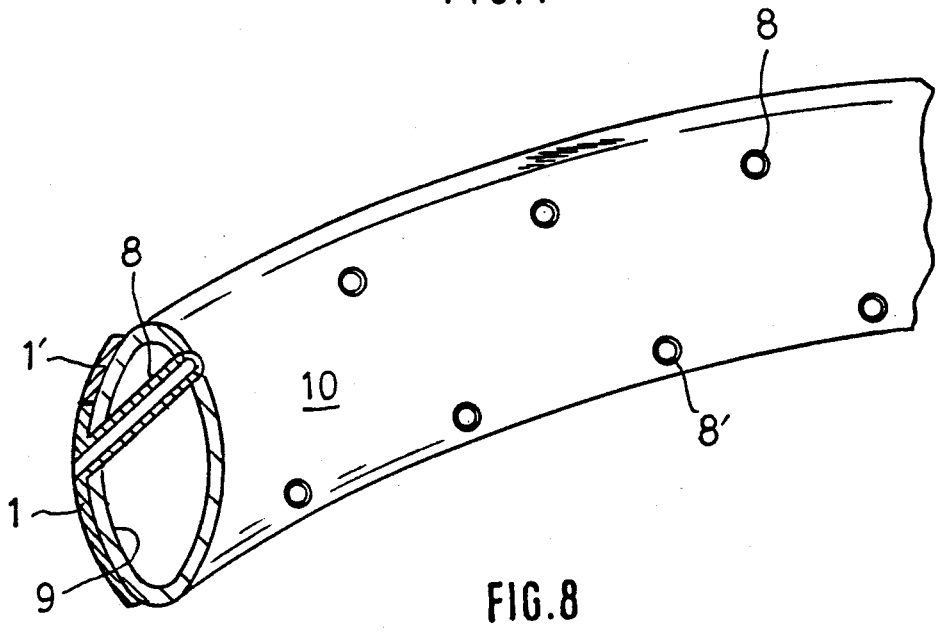
FIG. 8 is a fragmentary perspective view of the racket frame on which one half member of the bumper is installed in cross-section.
Figure 9:
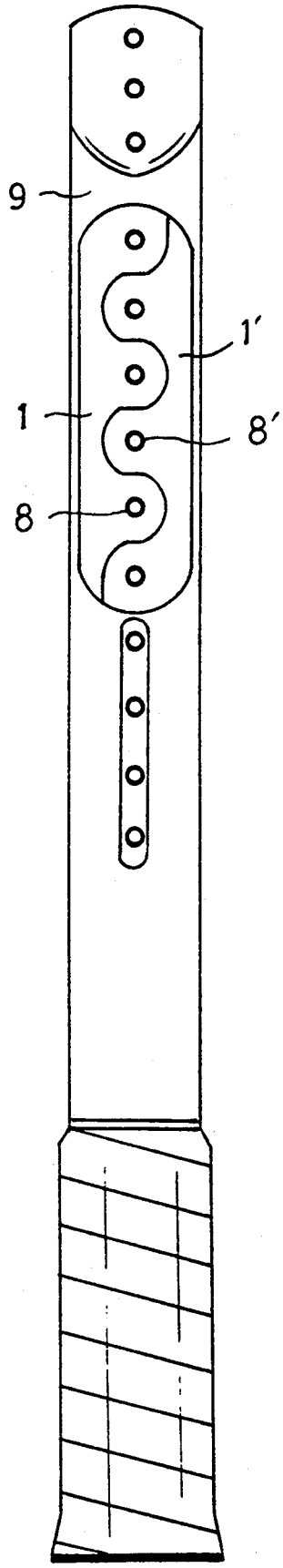
FIG. 9 is an elevational side view of the racket on which the bumper according to the present invention is installed.

As best seen from FIG. 7, each half member 1 comprises itself an elongated flat strip having inner surface 2 and outer surface 3 in parallel. Said strip is substantially flat at one lateral side 4 and is corrugated at another lateral side 5. The corrugated side 5 has alternating peak portions 6 and valley portions 7. A plurality of tubes 8 (also 8' in FIGS. 5, 6, 8 and 9) are integrally formed in the inner surface 2 and distributed each on one of the peak portions 6. Five tubes 8 are illustrated but not limited to this number. The tubes 8 are extended at an angle with respect to said inner surface 2 along the direction toward the rising of said peak portion 6 to a certain extent with a length substantially equal to the distance from the outside 9 of the frame obliquely to the inside 10 of the same, as best shown in FIG. 8. Two half members 1,1' are respectively installed onto the frame and combined to complete a whole unit. The tubes 8 and 8' on respective half member 1,1' obliquely pass through the frame from the outside a to the inside 10 thereof at the preformed holes along opposite directions, respectively. So that there are two rows of the holes at the inside 10 of the frame while only one row of the holes is illustrated at outside 9 of the frame, as shown in FIG. 9. In FIG. 9 it is seen that each half member 1,1' comprises three tubes 8,8', respectively. Further, from FIG. 9 it is apparent that the bumper according to the present invention covers only a portion rather than entire periphery of the frame, in cooperation with the racket with an improved vibration absorbing construction as disclosed in aforementioned U.S. patent application Ser. No. 07/918,466 which is incorporated herewith for reference.

Figure 10:
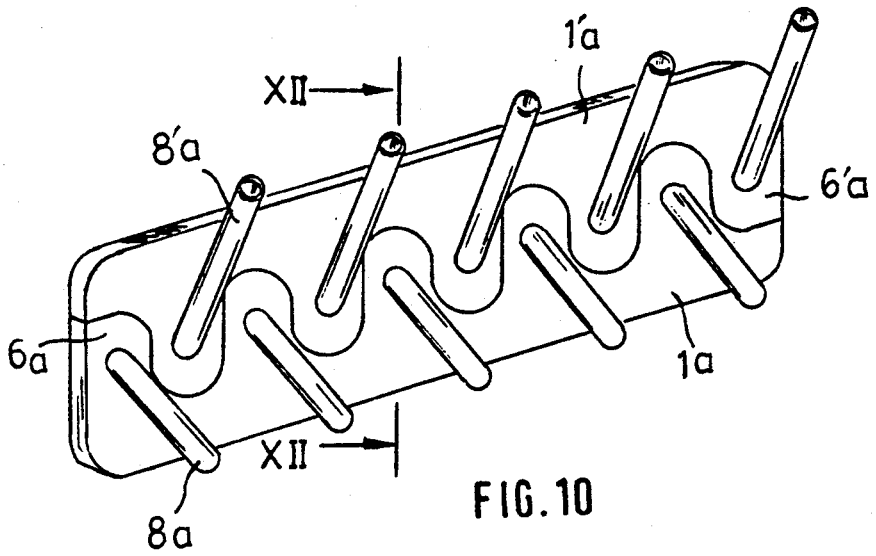
FIG. 10 is a perspective view depicting another embodiment of the bumper in combination according to the present invention.
Figure 11:
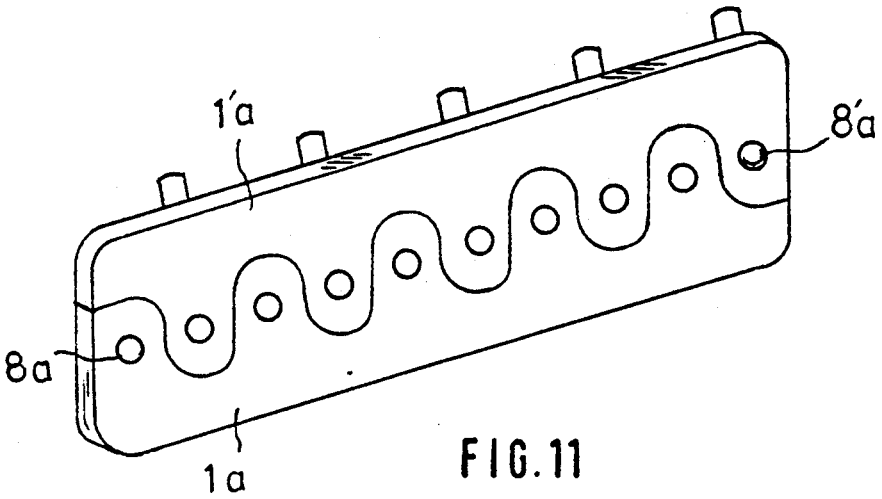
Figure 12:
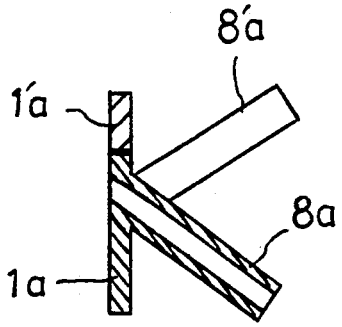

The second embodiment of the bumper according to the present invention is illustrated in FIG. 10, 11 and 12 which correspond to FIGS. 6, 9 and 6, respectively, of the first embodiment as mentioned above. In the second embodiment same reference symbols are designated to similar parts as in the first embodiment provided that suffix a is added respectively, and the detail description thereof is herein omitted. In comparison it is obvious that the second embodiment is distinguished from the first embodiment only that the tubes 8*a*, 8′*a* are extended along a direction opposite to the rising of said peck portions 6,6′.

While there have been shown and described what are at present considered the preferred embodiments of the present invention, it will be obvious to those skilled in the art that various changes and modifications may be made therein without departing from the scope of the invention as defined by the appended claims.

What I claim is:

1. A bumper for the racket frame having an outside and an inside, comprising two identical half members, in which each half member comprises:

a flat strip having parallel inner and outer surfaces, wherein one lateral side is substantially flat, while another lateral side is corrugated having alternating peak and valley portions, and a plurality of tubes integrally formed and distributed on said inner surface of said flat strip at respective said peak portion and extended at an angle with respect to said inner surface with a length substantially equal to a distance from said outside of said racket frame obliquely to said inside of said racket frame.

2. The bumper for the racket frame of claim 1, wherein said tubes extend along a direction toward the rising of said peak portion.

3. The bumper for the racket frame of claim 1, wherein said tubes extend along a direction opposite to the rising of said peak portion.

* * * * *